US005678289A

United States Patent [19]

Saaf

[11] Patent Number: 5,678,289

[45] Date of Patent: Oct. 21, 1997

[54] BURIAL CASKET WITH MUSIC MEDIA STORAGE AND DISPLAY AND WHEREIN CASKET DESIGN THEME CORRESPONDS TO MUSIC THEME

[75] Inventor: Patrick Michael Saaf, Batesville, Ind.

[73] Assignee: Batesville Casket Company, Inc., Batesville, Ind.

[21] Appl. No.: 583,220

[22] Filed: Jan. 4, 1996

[51] Int. Cl.[6] ..... A61G 17/00

[52] U.S. Cl. ..... 27/2; 27/1

[58] Field of Search ..... 27/1, 2, 14, 35; 40/491; D99/8, 15, 25, 43; 206/308.1, 387.13, 542; 312/234, 234.5, 9.47, 9.48, 317.1

[56] References Cited

U.S. PATENT DOCUMENTS

| | | | |
|---|---|---|---|
| D. 14,527 | 12/1883 | Reynolds . | |
| D. 19,506 | 12/1889 | Kagelmacher . | |
| D. 77,084 | 8/1928 | Fox . | |
| D. 84,768 | 4/1931 | Thompson . | |
| D. 88,953 | 10/1933 | Fumarol . | |
| D. 142,060 | 8/1945 | Butler . | |
| D. 333,372 | 2/1993 | Feeney . | |
| 430,395 | 6/1890 | McCarthy . | |
| 2,246,122 | 6/1941 | Brennan . | |
| 2,468,651 | 4/1949 | Blume . | |
| 2,528,913 | 11/1950 | Robinson . | |
| 2,676,383 | 4/1954 | Lipman . | |
| 2,712,191 | 7/1955 | Hillenbrand . | |
| 2,769,266 | 11/1956 | Feeley . | |
| 2,974,389 | 3/1961 | Tatum . | |
| 3,024,901 | 3/1962 | Ceralo . | |
| 3,025,624 | 3/1962 | Harrell . | |
| 3,115,434 | 12/1963 | Hahn . | |
| 4,697,316 | 10/1987 | Semon | 27/2 X |
| 4,738,361 | 4/1988 | Ackeret | 206/308.1 X |

OTHER PUBLICATIONS

Sep. 1995 Woodworker's Supply, Inc. Catalog pp. 1 and 148 Item: Magnetic Touch Latch.

*Primary Examiner*—Kien T. Nguyen
*Attorney, Agent, or Firm*—Wood, Herron & Evans, L.L.P.

[57] ABSTRACT

A combination comprises a burial casket designed and constructed so as to have a visible theme, a music media storage and display assembly incorporated into the casket selectively movable to and between a generally concealed storage position and a generally exposed display position, and music media including recorded music selected so as to have an audible theme, corresponding to the casket visible theme, stored and displayed in the assembly. The casket includes a shell and head end and foot end caps pivoted to said shell. The foot end cap includes a header board mounted on a head end thereof. The storage and display assembly comprises a platform slidable through the header board to and between the storage and display positions within and without the foot end cap respectively, the platform having a recess therein for receiving the music media, and an ejector mounted to the platform operable to eject the music media from the recess for easy grasping when the platform is moved to the display position.

9 Claims, 3 Drawing Sheets

BURIAL CASKET WITH MUSIC MEDIA STORAGE AND DISPLAY AND WHEREIN CASKET DESIGN THEME CORRESPONDS TO MUSIC THEME

FIELD OF THE INVENTION

This invention relates generally to burial caskets, and more particularly to a burial casket having provision for storing and displaying music media therewith and designed to correspond to the music recorded on the media.

BACKGROUND OF THE INVENTION

One factor involved in the selection of a burial casket by the loved ones of a deceased has been the outwardly visible ornamental design of the casket. Consequently, many different designs of caskets are traditionally offered to customers so that those customers may choose a particular casket design which is in accordance with the wishes of the deceased and/or presents the image which the loved ones wish to impart as a final remembrance of the deceased.

Two materials of which ornamental caskets may be fabricated are metal and wood. If fabricated of metal, not only are different metals having different colors, lusters, etc. available but metal caskets are offered having various external ornamental configurations or appearances, various decorative hardware, etc. The same generally holds with wood caskets. Different woods having different colors and grain patterns are available. The external ornamental configuration of wood caskets vary. Decorative carving or inlays are customary in wood caskets. Lastly, as with metal caskets, decorative hardware varies from wood casket to wood casket.

Along these lines, some caskets are designed and constructed to present a particular "theme," often, but not necessarily, a religious theme. For example, a casket may include a large cross mounted atop the casket cap. Or the casket may be adorned with angels or the like. The interior decorative fabric, for example big body or small body, may be of a particular style, for example Kinte cloth, or the decorative cap panel (or cap panel insert) may include a decorative design which relates to an outdoor theme, for example fly fishing or the like, or to a sports theme, for example the logo of a college or the like.

It is believed that when more than one sense can be involved in the perception of a message, for example simultaneously seeing and hearing the message as opposed to either simply seeing or simply hearing the message, the impression of the message upon the recipient as well as the retention of the message by the recipient is increased.

Accordingly, it is a major objective of the present invention to involve an additional sense, in addition to that of sight, in the selection of burial caskets by the loved ones of the deceased in order to make a more lasting impression of the deceased and the funeral or other memorial service for the deceased on the loved ones of the deceased.

Another objective of the present invention is to involve the sense of hearing, in addition to the sense of sight, in the aforementioned casket selection and memorial service process.

Yet another objective of the present invention is to provide a burial casket with the means for combining the senses of sight and hearing in the aforementioned casket selection and memorial service process.

SUMMARY OF THE INVENTION

In accordance with the stated objectives, the present invention is a combination comprising a burial casket designed and constructed so as to have a visible theme, a music media storage and display assembly incorporated into the casket selectively movable to and between a generally concealed storage position and a generally exposed display position, and music media including recorded music selected so as to have an audible theme, corresponding to the casket visible theme, stored and displayed in the assembly.

In one particular preferred embodiment of the present invention, the burial casket includes a shell and a cap pivoted to the shell, with the cap having a cross mounted thereon. The music media includes the song "The Old Rugged Cross" recorded thereon. One particular preferred embodiment of the music media is a compact disc.

In another aspect of the present invention, the burial casket includes a shell and head end and foot end caps pivoted to said shell. The foot end cap includes a header board mounted on a head end thereof. The storage and display assembly comprises a platform slidable through the header board to and between the storage and display positions within and without the foot end cap respectively. The platform has a recess therein for receiving the music media or other object. An ejector is mounted to the platform and is operable to eject the music media from the recess for easy grasping when the platform is moved to the display position.

The ejector comprises an elongated bar having first and second ends. The bar is pivoted to the platform beneath the platform music media recess at a point along the bar nearer to the first end than to the second end. The bar is received in a recess in the bottom of the platform when the platform is in the storage position. The platform includes a hole through which the bar first end projects when the platform is moved to the display position and the bar second end pivots downwardly under gravity thus pivoting the bar first end upwardly. The bar first end thereby urges the music media upwardly.

The storage and display assembly further comprises a magnetic spring-biased detent latch mounted within the foot end cap and a metallic fastener attached to the foot end of the platform and cooperable with the latch. The fastener cooperates with the latch such that when the platform is slid inwardly into the foot end cap the fastener becomes magnetically attached to the latch; further inward sliding of the platform against the latch spring-bias causes the latch to engage the latch detent. The fastener further cooperates with the latch such that upon further inward sliding of the platform against the latch spring-bias the latch disengages the latch detent and the platform is ejected slightly out of the foot end cap by the spring-bias, at which time the platform may be grasped and pulled outwardly breaking the magnetic connection between the latch and the fastener at that time and slid to the display position.

One advantage of the present invention is that an additional sense, in addition to that of sight, is involved in the selection of burial caskets by the loved ones of the deceased in order to make a more lasting impression of the deceased and the funeral or other memorial service for the deceased on the loved ones of the deceased.

Another advantage of the present invention is that the sense of hearing, in addition to the sense of sight, is involved in the aforementioned casket selection and memorial service process. Loved ones listening, subsequent to the memorial service for the deceased, to the music on the music media, which was combined with the casket during casket selection, will associate the music and the casket design together, reinforcing in their minds the appropriateness and hence the value of the casket they selected for the deceased.

Yet another advantage of the present invention is that a burial casket is provided with the means for combining the senses of sight and hearing in the aforementioned casket selection and memorial service process, namely by way of the incorporation into the casket of a music media storage and display assembly.

These and other objects and advantages of the present invention will become more readily apparent during the following detailed description taken in conjunction with the drawings herein, in which:

DETAILED DESCRIPTION OF THE INVENTION

Figure 1:
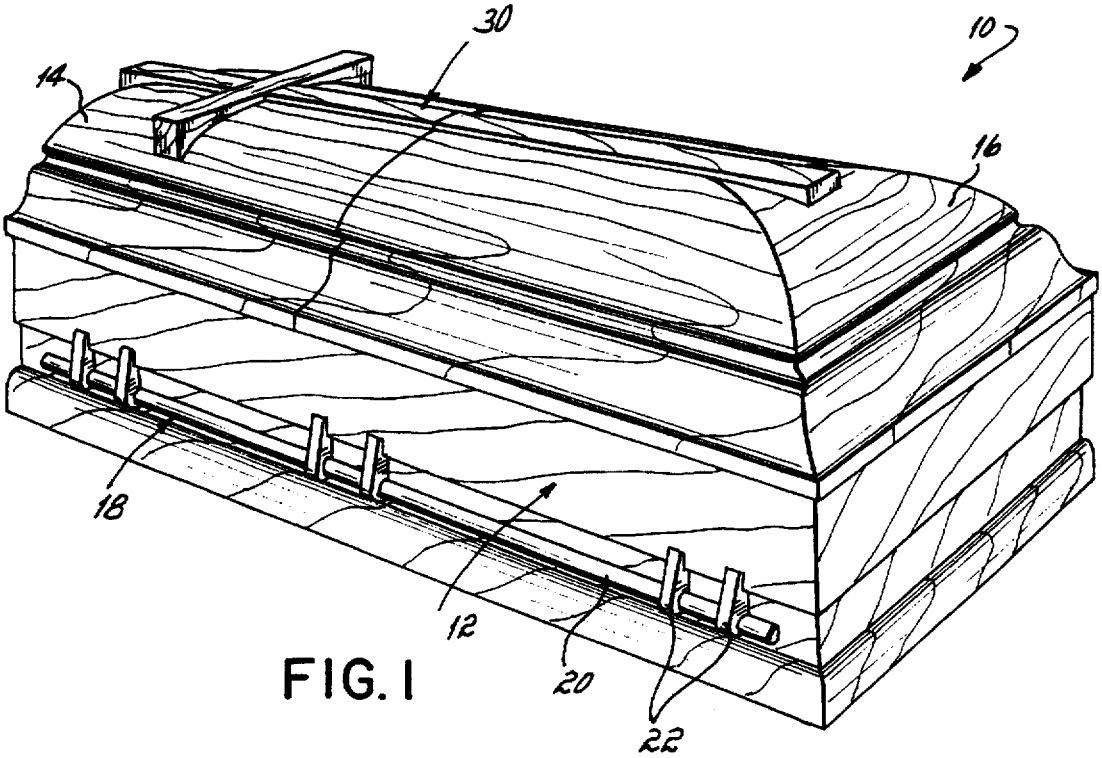
FIG. 1 is a perspective view of a casket according to the present invention.

Referring first to FIG. 1, there is illustrated a casket 10 according to the principles of the present invention. The casket 10, illustrated as wood but it will be appreciated that metal caskets are contemplated as being within the scope of the present invention, includes a shell 12 including head end 14 and foot end 16 caps pivoted thereto. Handling structure 18 takes the form of an elongated handle bar 20 connected through arms 22 to the shell 12 with fasteners (not shown). A large decorative cross 30 is mounted to the caps 14 and 16.

Figure 2:
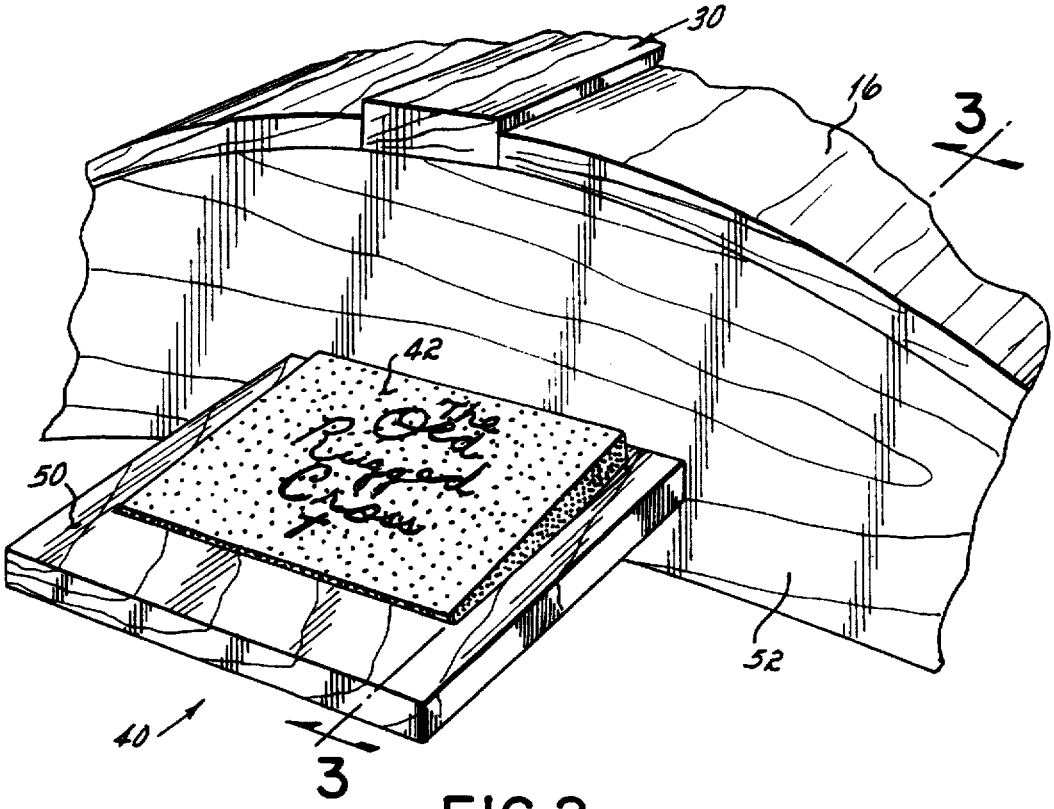
FIG. 2 is a head end partial perspective view of the foot end cap of the FIG. 1 casket including provision for storing and displaying music media.

Referring now to FIG. 2, there is illustrated a music media storage and display assembly 40 including a compact disc ("CD") 42 displayed therein. The CD includes music recorded thereon which has a theme which corresponds to the casket design, i.e. includes the song "The Old Rugged Cross" recorded thereon to correspond to the cross 30 of the casket 10. The CD may be retained by loved ones subsequent to the funeral or other memorial service and replayed later as a memorial or the like to the deceased. Other types of music media may be of course stored and displayed in the assembly 40 such as audio cassettes, VHS audio/video cassettes, 8-track tapes, etc., and the invention is therefore not limited to CD's.

The assembly includes a platform 50 slidable through a header board 52 in the foot end cap 16, which is visible to onlookers when the head end cap 14 is opened during viewing. The platform 50 is slidable to and between a storage position (FIG. 3A) within the foot end cap 16 and a display position (FIG. 3) without the foot end cap 16.

Figure 3:
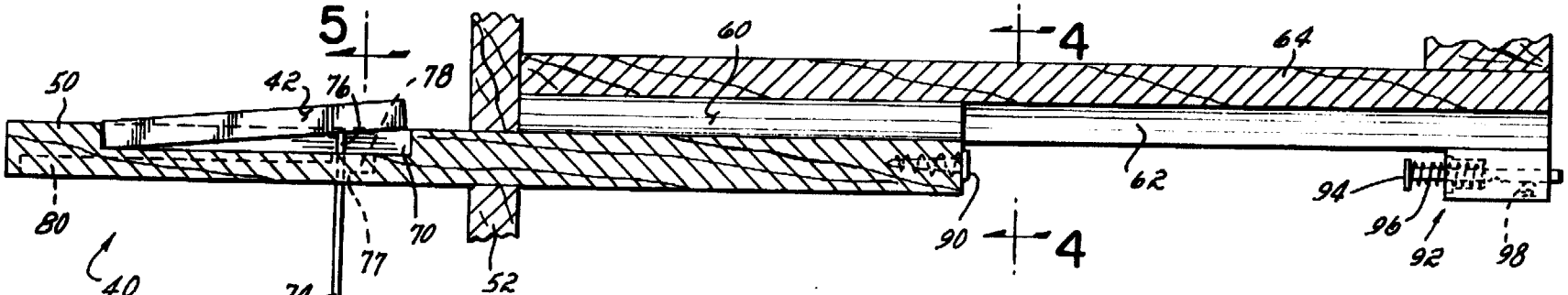
FIG. 3 is a view taken along line 3—3 of FIG. 2.
Figure 3A:
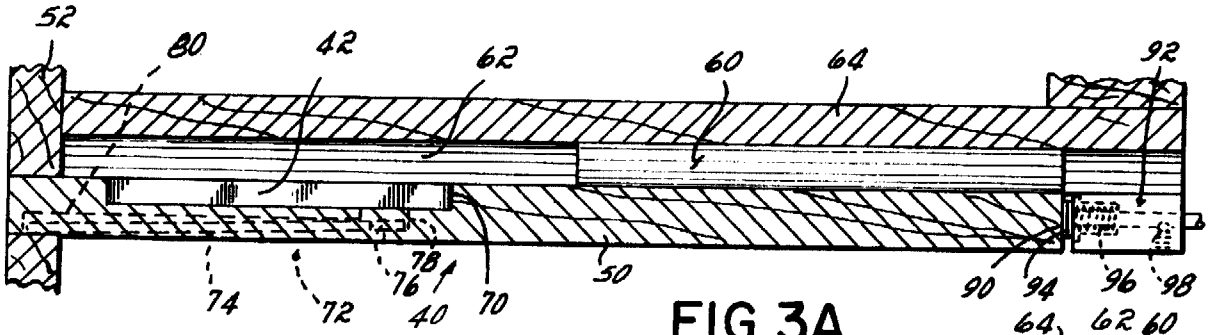
FIG. 3A is a view similar to FIG. 3 but with the music media stored.
Figure 3B:
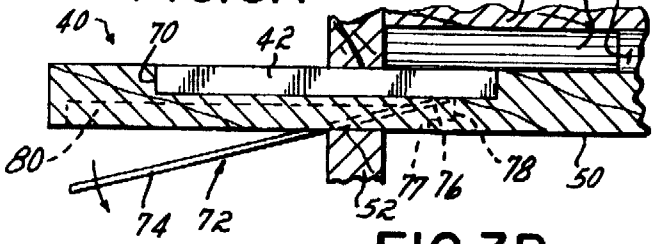
FIG. 3B is a view similar to FIG. 3 but with the music media partially displayed.
Figure 4:
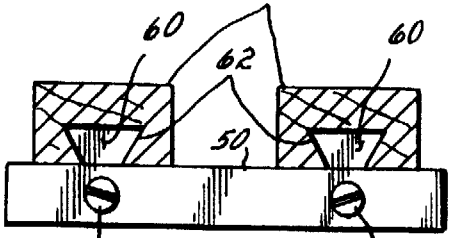
FIG. 4 is a view taken along line 4—4 of FIG. 3.
Figure 5:
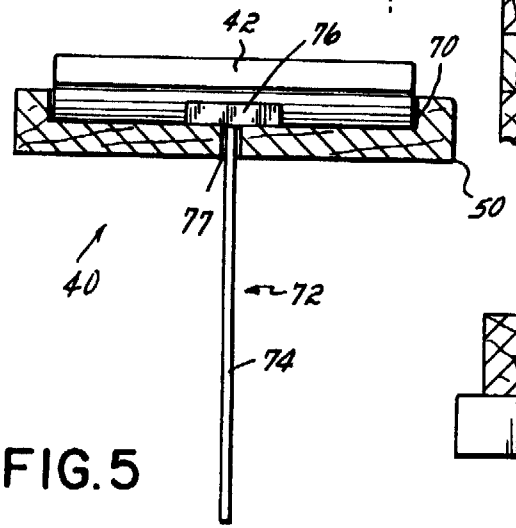
FIG. 5 is a view taken along line 5—5 of FIG. 4.

Referring now to FIGS. 3, 3A, 3B, 4 and 5, platform 50 includes a pair of elongated tongues 60 which slide in a pair of grooves 62 in supports 64 mounted within foot end cap 16. Platform 50 includes a recess 70 in an upper surface thereof which permits the CD to be positioned flushly with the upper surface of the platform. An ejector 72 is pivoted to the platform 50 for ejecting the CD as shown in FIG. 3. Ejector 72 includes an elongated portion 74 and a cross-piece or head 76 mounted on an upper end thereof. Elongated portion 74 passes through a hole 77 in the platform 50. A recess 78 in the upper side of the platform 50 accommodates the cross-piece 76 and a recess 80 in the lower side of the platform 50 accommodates the elongated portion 74 during storage of the platform 50 within foot end cap 16 (FIG. 3A). When the platform 50 is moved from the storage position to the display position (FIG. 3B), the weight of the elongated portion 74 causes it to pivot downwardly under the influence of gravity at which time the cross-piece 76 pivots upwardly to urge the CD 42 upwardly.

A pair of screws 90 are screwed in the foot end of the platform 50 and cooperate with a pair of magnetic spring-biased detent latches 92 mounted to the supports 64. Magnetic spring-biased detent latches may be purchased from Wood Workers Supply of New Mexico as part number 199-001. The magnetic spring-biased detent latch is shown diagrammatically with a magnetic actuator head 94, compression spring 96 and detent 98. The screws 90 cooperate with the latch 92 such that when the platform is slid inwardly into the foot end cap 16 the screw 90 becomes magnetically attached to the head 94. Further inward sliding of the platform 50 against the bias of spring 96 causes the latch 92 to engage the latch detent 98 retaining the platform within the foot end cap 16. Upon again forcing the platform 50 inwardly into the foot end cap 16 against the bias of the spring 96 the latch 92 disengages the latch detent 98 and the platform is ejected slightly out of the foot end cap 16 by the spring 96, at which time the platform may be grasped and pulled outwardly breaking the magnetic connection between the head 94 and the screws 90 and slid to the display position.

Figure 6:
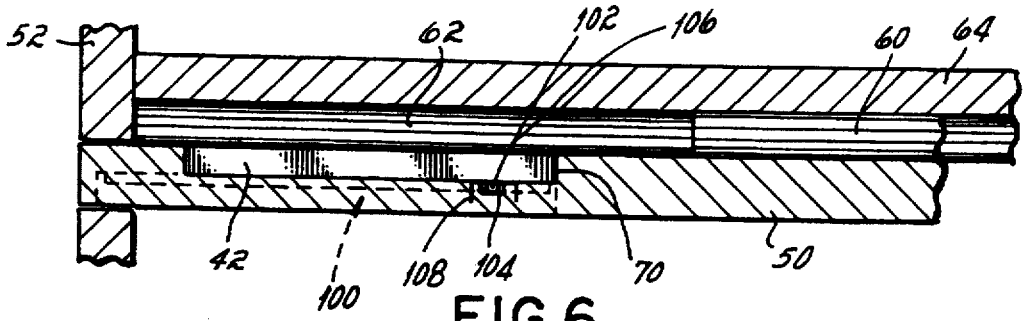
FIG. 6 is a view similar to FIG. 3A of an alternative embodiment of ejector.
Figure 7:
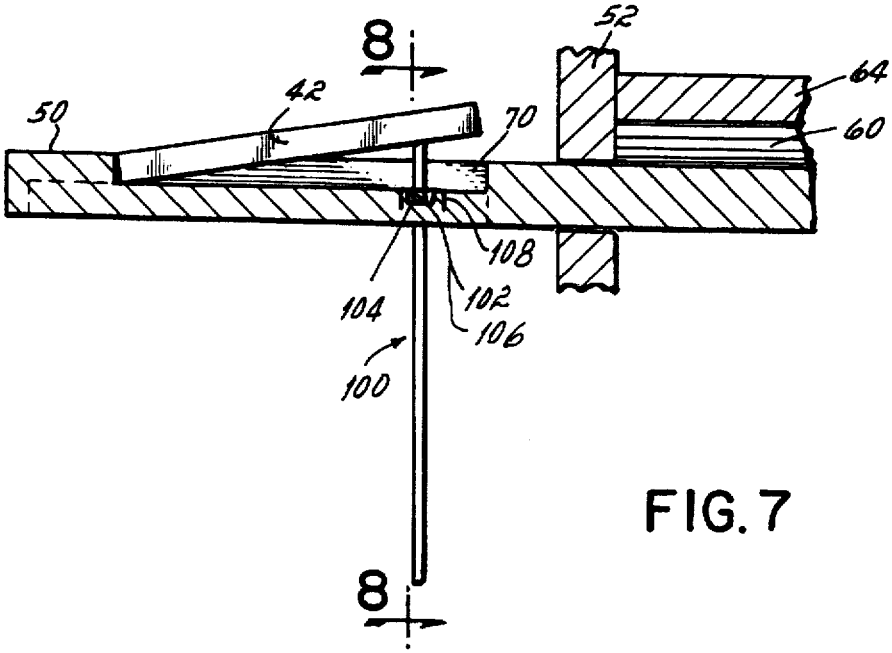
FIG. 7 is a view similar to FIG. 3 of the FIG. 6 ejector.
Figure 8:
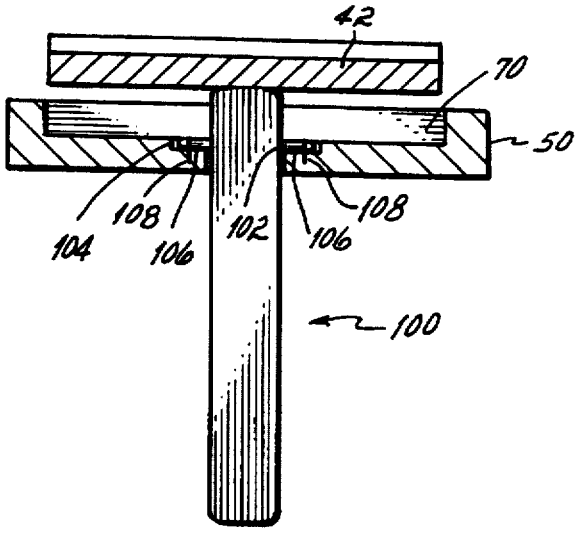
FIG. 8 is a view taken along line 8—8 of FIG. 7.

Referring now to FIGS. 6–8 there is illustrated an alternative embodiment of the ejector. In this embodiment an elongated bar 100 includes a pin 102 pressed therethrough which rides in a groove 104 in the bottom of the recess 70 of the platform 50. The ends 106 of the pin 102 are retained by staples 108 pressed into the platform 50.

Those skilled in the art will readily recognize numerous adaptations and modifications which can be made to the present invention which will result in an improved burial casket with provision for storing and displaying music media, yet all of which will fall within the spirit and scope of the present invention as defined in the following claims. Accordingly, the invention is to be limited only by the scope of the following claims and their equivalents.

What is claimed is:

1. A combination comprising:

a burial casket designed and constructed so as to have a visible theme;

a music media storage and display assembly incorporated into said casket selectively movable to and between a generally concealed storage position and a generally exposed display position; and music media including recorded music selected so as to have an audible theme, corresponding to said casket visible theme, stored and displayed in said assembly.

2. The combination of claim 1 wherein:

said burial casket includes a shell and a cap pivoted to said shell, said cap having a cross mounted thereon; and said music media includes the song "The Old Rugged Cross" recorded thereon.

3. The combination of claim 2 wherein said music media is a compact disc.

4. A combination comprising:

a burial casket designed and constructed so as to have a visible theme;

a music media storage and display assembly incorporated into said casket selectively movable to and between a generally concealed storage position and a generally exposed display position; and music media including recorded music selected so as to have an audible theme, corresponding to said casket visible theme, stored and displayed in said assembly;

wherein:

said burial casket includes a shell and head end and foot end caps pivoted to said shell;

said foot end cap including a header board mounted on a head end thereof; and said storage and display assembly comprises:

a platform slidable through said header board to and between a storage position within said foot end cap and a display position without said foot end cap;

said platform having a recess therein for receiving said music media; and an ejector mounted to said platform operable to eject said music media from said recess for easy grasping when said platform is moved to said display position.

5. The combination of claim 4 wherein said ejector comprises:

an elongated bar having first and second ends, said bar being pivoted to said platform beneath said platform music media recess at a point along said bar nearer to said first end than to said second end;

said bar being received in a recess in the bottom of said platform when said platform is in the storage position;

said platform including a hole through which said bar first end projects when said platform is moved to the display position and said bar second end pivots downwardly under gravity thus pivoting said bar first end upwardly, said bar first end thereby urging said music media upwardly.

6. The combination of claim 5 wherein:

said storage and display assembly further comprises a magnetic spring-biased detent latch mounted within said foot end cap and a metallic fastener attached to the foot end of said platform and cooperable with said latch;

said fastener cooperating with said latch such that when said platform is slid inwardly into said foot end cap said fastener becomes magnetically attached to said latch, and upon further inward sliding of said platform against the latch spring-bias causes said latch to engage the latch detent;

said fastener further cooperating with said latch such that upon further inward sliding of said platform against the latch spring-bias said latch disengages the latch detent and said platform is ejected slightly out of said foot end cap by said spring-bias, at which time said platform may be grasped and pulled outwardly breaking the magnetic connection between said latch and said fastener at that time and slid to the display position.

7. A burial casket comprising:

a shell;

head end and foot end caps pivoted to said shell;

said foot end cap including a header board mounted on a head end thereof; and an object storage and display assembly incorporated into said foot end cap comprising:

a platform slidable through said header board to and between a generally concealed storage position within said foot end cap and a generally exposed display position without said foot end cap;

said platform having a recess therein for receiving an object; and an ejector mounted to said platform operable to eject the object from said recess for easy grasping when said platform is moved to said display position.

8. The burial casket of claim 7 wherein said ejector comprises:

an elongated bar having first and second ends, said bar being pivoted to said platform beneath said platform object recess at a point along said bar nearer to said first end than to said second end;

said bar being received in a recess in the bottom of said platform when said platform is in the storage position;

said platform including a hole through which said bar first end projects when said platform is moved to the display position and said bar second end pivots downwardly under gravity thus pivoting said bar first end upwardly, said bar first end thereby urging the object upwardly.

9. The burial casket of claim 8 wherein:

said storage and display assembly further comprises a magnetic spring biased detent latch mounted within said foot end cap and a metallic fastener attached to the foot end of said platform and cooperable with said latch;

said fastener cooperating with said latch such that when said platform is slid inwardly into said foot end cap said fastener becomes magnetically attached to said latch, and upon further inward sliding against the latch spring bias causes said latch to engage the latch detent;

said fastener further cooperating with said latch such that upon further inward sliding against the latch spring bias said latch disengages the latch detent and said platform is ejected slightly out of said foot end cap by said spring bias, at which time said platform may be grasped and pulled outwardly breaking the magnetic connection between said latch and said fastener at that time and slid to the display position.

* * * * *